US007070214B2

(12) United States Patent
Fisher et al.

(10) Patent No.: US 7,070,214 B2
(45) Date of Patent: Jul. 4, 2006

(54) LOCK MECHANISM

(75) Inventors: Sidney Edward Fisher, Redditch (GB); Gurbinder Singh Kalsi, Oldbury (GB); Stephen Drysdale, Northampton (GB); Robert Frank Tolley, Cannock (GB)

(73) Assignee: ArvinMeritor Light Vehicle Systems (UK) Ltd., West Midlands (GB)

( * ) Notice: Subject to any disclaimer, the term of this patent is extended or adjusted under 35 U.S.C. 154(b) by 0 days.

(21) Appl. No.: 10/958,180

(22) Filed: Oct. 4, 2004

(65) Prior Publication Data

US 2005/0077733 A1 Apr. 14, 2005

(30) Foreign Application Priority Data

Oct. 4, 2003 (GB) ..... 0323268.3

(51) Int. Cl.
*E05C 3/06* (2006.01)
*E05B 53/00* (2006.01)

(52) U.S. Cl. ..... 292/216; 292/201; 292/DIG. 23; 70/262; 70/264

(58) Field of Classification Search ..... 70/362–364, 70/278.6, 278.7, 262–264; 292/201, 210, 292/216, DIG. 23, DIG. 61, DIG. 62
See application file for complete search history.

(56) References Cited

U.S. PATENT DOCUMENTS 4,364,249 A * 12/1982 Kleefeldt ..... 70/264
4,433,355 A * 2/1984 Chew et al. ..... 70/277
4,986,098 A * 1/1991 Fisher ..... 70/262
5,603,537 A * 2/1997 Amano et al. ..... 70/264
5,722,272 A 3/1998 Bridgeman et al.
6,367,296 B1 * 4/2002 Dupont ..... 292/201
6,523,376 B1 * 2/2003 Baukholt et al. ..... 70/256
6,729,663 B1 * 5/2004 Fisher ..... 292/201
2002/0043084 A1 * 4/2002 Fisher ..... 70/201
2003/0177974 A1 * 9/2003 Dominique ..... 70/264

FOREIGN PATENT DOCUMENTS

EP 0 302 642 A1 2/1989
EP 0 829 602 3/1998
EP 1 213 423 6/2002
EP 1286011 A1 * 2/2003
EP 1 149 967 A3 3/2003

OTHER PUBLICATIONS

European Search Report dated Apr. 15, 2005.
International Search Report, dated Mar. 9, 2004.

* cited by examiner

*Primary Examiner*—Brian E. Glessner
*Assistant Examiner*—Christopher Boswell
(74) *Attorney, Agent, or Firm*—Carlson, Gaskey & Olds

(57) ABSTRACT

A lock mechanism has a manually actuable element, a lock lever and an actuator, with the manually actuable element connected to the lock lever via a transmission path. The transmission path includes a rigid link with an end defining an abutment for selectively driving the lock lever. A drive feature couples the abutment to the lock lever when the lock lever is rotated between locked and unlocked positions by operation of the manually actuable element. The drive feature decouples the abutment from the lock lever when the manually actuable element is actuated in an attempt to move the lock lever from a superlocked position, allowing the abutment to move relative to the lock lever.

22 Claims, 9 Drawing Sheets

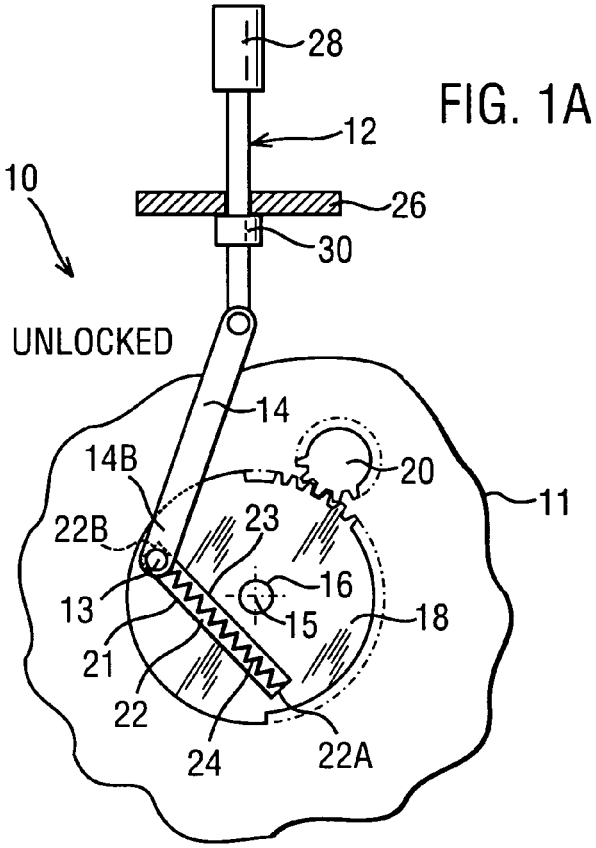
FIG. 1A
FIG. 1B
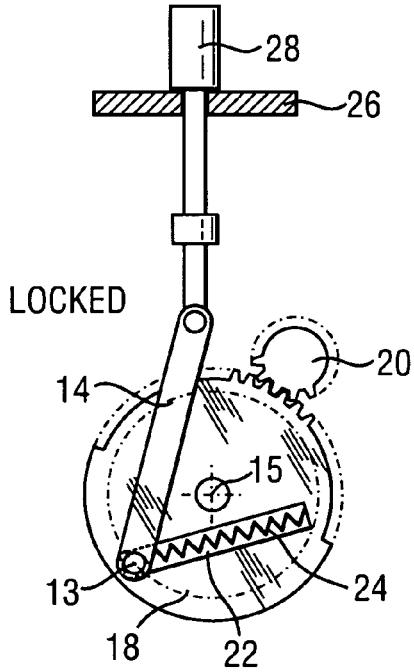

RELEASED 40
43
54
60
52
62
64
20
46
48
22
50
44
70
14
42
26
24

UNLOCKED
60
54
52
62
56
66
46B
48
58
43
42

LOCKED
66
54
52
64
56
48
26
43
58
46B
42
14
46A

LOCK MECHANISM

REFERENCE TO RELATED APPLICATION

This application claims priority to United Kingdom Patent Application 0323268.3 filed on Oct. 4, 2003.

TECHNICAL FIELD

The present invention relates to lock mechanisms and in particular to lock mechanisms on vehicle doors.

BACKGROUND OF THE INVENTION

Lockable latch mechanisms are used in vehicles and can be in an unlocked condition (i.e., allowing opening of an associated door from the outside and from the inside), a locked condition (i.e., preventing opening of the door from the outside but allowing opening of the door from the inside), and a superlocked condition (i.e., preventing opening of the door from both the inside and the outside).

European Patent Application EP 01303421 discloses a lock mechanism operable from the inside of a vehicle by a sill button or toggle switch. The sill button is connected to the lock mechanism via a coil bound helical spring. This spring acts in a non-resilient manner when the sill button is subsequently operated to move the lock mechanism between the locked and unlocked conditions. When the lock mechanism is electrically driven to the superlocked condition, the helical spring prevents the sill button from actuating the lock mechanism by acting in a resilient manner when the sill button is operated in an attempt to move the lock mechanism from the superlocked condition.

However, if the vehicle is involved in a collision, there may be sufficient damage to the lock mechanism to cause the lock mechanism to partially seize. If the lock mechanism were locked at the time of the collision, exit from the vehicle may be impeded because the helical spring may elastically deform rather than transmitting sufficient force to the lock mechanism to unlock the lock mechanism. In such circumstances, it would be very difficult to unlock the door from the inside of the vehicle.

An object of the present invention is to provide an improved lock mechanism that overcomes these deficiencies.

SUMMARY OF THE INVENTION

One embodiment of the invention is directed to a lock mechanism including a manually actuable element, a lock lever and an actuator, the manually actuable element being connected to the lock lever via a transmission path. The lock lever has locked, unlocked and superlocked positions relating to locked, unlocked and superlocked conditions of the lock mechanism. The lock lever is rotatable about an axis between locked, unlocked and superlocked positions by the actuator. The lock lever is also rotatable about the axis between the locked and unlocked positions by operation of the manually actuable element.

The transmission path of the lock lever includes a rigid link having a first end in driven connection with the manually actuable element and a second end defining an abutment for selectively driving the lock lever via a drive feature that couples the abutment to the lock lever so that the abutment follows an arcuate path centered on the axis when the lock lever is rotated about the axis between locked and unlocked positions by operation of the manually actuable element.

The drive feature also decouples the abutment from the lock lever when the manually actuable element is actuated in an attempt to move the lock lever from the superlocked position so that the abutment moves relative to the lock lever.

BRIEF DESCRIPTION OF THE DRAWINGS

The invention will now be described by way of example only with reference to the accompanying drawings in which:

FIGS. 1A to 1D are schematic views of a first embodiment of a lock mechanism in accordance with the present invention.

DETAILED DESCRIPTION OF THE PREFERRED EMBODIMENT

Figure 1C:
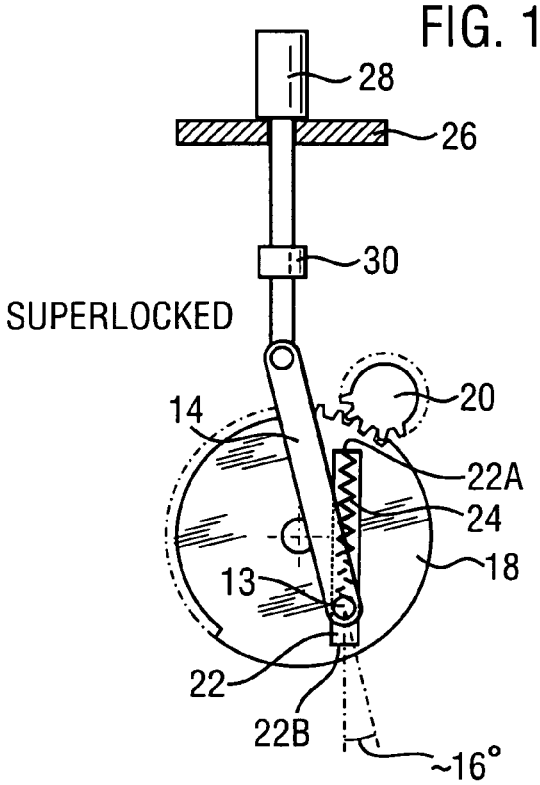

FIGS. 1A to 1D show a lock mechanism 10 having a manually actuable element in the form of a sill button 12. The sill button 12 is mounted on a vehicle door panel 26. Downward movement of the sill button 12 is restricted by a sill button head 28 and upward movement is prevented by a sill button stop 30. The sill button 12 is connected via a rigid link in the form of a connection rod 14 to a lock lever in the form of a lock gear 18. The lock gear 18 is rotationally mounted to a chassis 11 at an axis 15 on a pivot 16 and is driven by a stepper motor (not shown for clarity) via pinion gear 20. It will be appreciated that the chassis 11 is not shown in FIGS. 1B to 1D for clarity.

The lock gear 18 includes an opening in the form of a slot or channel 22. An elongate axis of the channel 22 is arranged upon a chord of a circle defined about the axis 15. A pre-loaded compression spring 24 is located within the channel 22. One end of the spring 24 abuts an end face 22A of the channel 22. The other end of the spring 24 is in contact with an abutment 13 defined by the lower end of the connection rod 14. The abutment 13 is retained within the channel 22 such that it may slide along the channel against the resistance of the spring 24.

The spring 24 and the abutment 13 form a drive feature that maintains a lower end 14B of the connection rod 14 in driven contact with a second end 22B of the channel 22 during selected motor and manual operations of the lock mechanism 10, as will be explained further below.

Figure 1D:
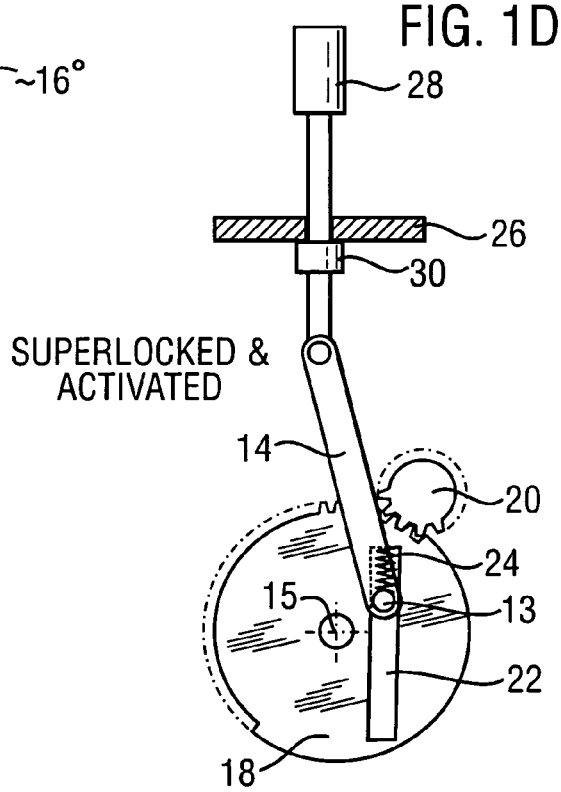

The sill button 12 has an unlocked position (FIG. 1A) and a locked position (FIG. 1B). The lock gear 18 has an unlocked position (FIG. 1A), a locked position (FIG. 1B), and a superlocked position (FIGS. 1C and 1D).

The lock gear 18 is connected to further components of a latch (not shown) to provide corresponding unlocked, locked and superlocked conditions of the latch.

Operation of the lock mechanism is as follows:

When the lock mechanism 10 is positioned as shown in FIG. 1A, the sill button 12 and the lock gear 18 are in their respective unlocked positions. When the sill button 12 is manually moved from the unlocked position shown in FIG. 1A to the locked position shown in FIG. 1B, the load applied to the connection rod 14 via the sill button 12 causes the abutment 13 to engage with a first wall 21 of the channel 22 at a position adjacent the second end 22B of the channel 22. The reaction between the abutment 13 and the first wall 21, under the biasing action of the spring 24, generates sufficient friction to maintain a driven connection between the connection rod 14 and the lock gear 18, thus moving the lock gear 18 from its unlocked position to its locked position.

While the spring 24 acts on the abutment 13 throughout the rotation of the lock gear 18 from the unlocked to the locked position, its main purpose during manual unlocking is to provide a reaction against the abutment 13 until the angle between the channel 22 and the connection rod 14 reaches around 90°. Beyond this point, the biasing force of the spring 24 becomes redundant and the abutment 13 acts directly on the second end 22B and the first wall 21. Operation during electrical locking may be different, as will be described in greater detail below.

It will be appreciated that initial movement of the sill button 12 and the lock gear 18 will do little work because the slack in the system will need to be taken up. Thus, the angle between the channel 22 and the connection rod 14 will have started to approach 90° before any significant torque is applied to the lock gear 18. Movement of the lock gear 18 will be achieved upon generation of a sufficient force between the abutment 13 and the lock gear 18.

When the pinion gear 20 is driven by a stepper motor upon electrical locking of the door, the lock gear 18 is driven to the locked position as shown in FIG. 1B. During this operation, the load applied to the abutment 13 by the spring 24 is redundant until the channel 22 has been rotated past a position where it is at a 90° angle with respect to the connection rod 14. After this point, the abutment 13 acts in conjunction with a second wall 23 and the spring 24 in a similar way to that described above, under manual locking of the lock mechanism.

When the lock gear 18 is moved from the locked position shown in FIG. 1B to the unlocked position shown in FIG. 1A by manual actuation of the sill button 12, the abutment 13 is retained by the spring 24 and the second wall 23 of the channel 22 until the angle between the connection rod 14 of the sill button 12 and the channel 22 is greater than 90° degrees. When the lock mechanism 10 is electrically driven between the locked and unlocked positions, the load applied by the spring 24 on the abutment 13 is redundant until the lock gear 18 has rotated past the point where the angle between the connection rod 14 and the channel 22 is 90° degrees.

In the manner described above, the lock mechanism can be either manually or electrically moved between the unlocked position shown in FIG. 1A and the locked position shown in FIG. 1B.

To superlock the door, the stepper motor drives the lock gear 18 via the pinion gear 20 from its locked position shown in FIG. 1B to its superlocked position shown in FIG. 1C. Note that when the lock mechanism 10 is in the superlocked position, the abutment 13 has rotated over-center with respect the axis 15 of the lock gear 18. In the superlocked position, the angle between a longitudinal axis of the connection rod 14 and the elongate axis of the channel 22 is small (in this example, 16°) as shown in FIG. 1C. As a result, when the sill button 12 is actuated (for example, by a thief attempting to gain entry to the associated vehicle) in an attempt to move the latch mechanism from the superlocked position, the spring 24 compresses as shown in FIG. 1D and the lock remains in the superlocked condition.

It will be appreciated that the abutment 13 does not need to go over-center with respect to the pivot 16. The lock mechanism 10 will operate satisfactorily as long as the angle between the connection rod 14 and the channel 22 is sufficiently acute so that the spring 24 will compress upon actuation of the sill button 12 in an attempt to move the lock mechanism 10 from the superlocked position.

In other words, the angle between the connection rod 14 and the channel 22 must be sufficiently small such that a combination of the spring force and friction force generated by the reaction of the abutment 13 with the channel 22 is less than the force required to achieve a torque that will back-drive the stepper motor. When this condition is met, the spring 24 will compress when an attempt is made by the thief to move the lock gear 18 from the superlocked condition.

The lock mechanism 10 will remain in the superlocked and activated state shown in FIG. 1D until the sill button 12 is released. When the sill button 12 is released, the spring 24 will return the lock mechanism 10 to the superlocked condition shown in FIG. 1C.

As a result of this arrangement, manual operation of the lock mechanism 10 via the sill button 12 between unlocked and locked positions is achieved with the connection rod 14 in constant driven contact with the lock gear 18. Consequently, where the lock mechanism 10 partially seizes following, for example, an impact from a second vehicle, occupants are able to unlock the lock mechanism 10 because there is a direct drive connection between the abutment 13 and the lock gear 18 when the lock gear 18 is moved from its locked position (FIG. 1B) to its unlocked position (FIG. 1A).

It will be appreciated that the spring 24 acts only in a single direction, namely in compression. At no point during normal operation of the lock mechanism 10 is the spring 24 required to act in tension.

Figure 2A:
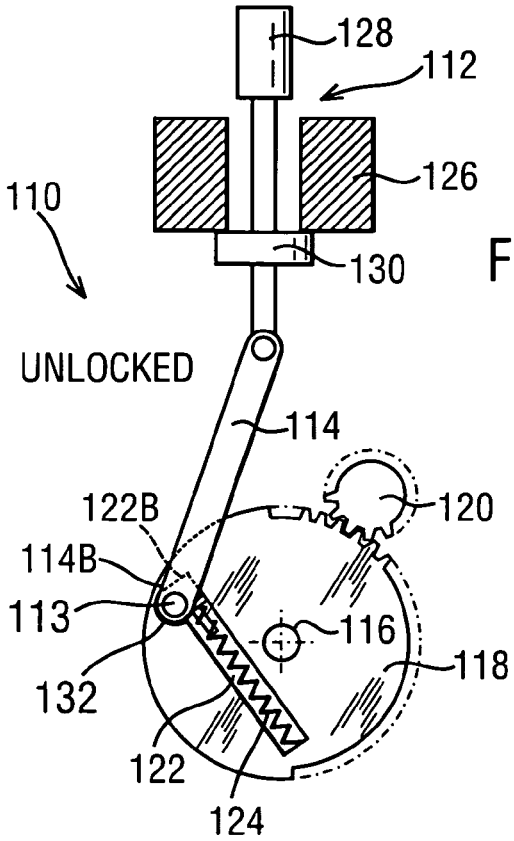
FIGS. 2A to 2C are schematic views of a second embodiment of the lock mechanism according to the present invention.
Figure 2B:
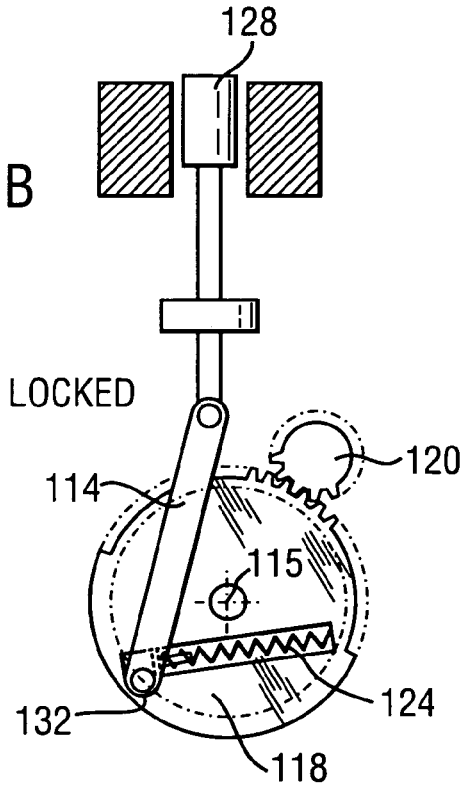
Figure 2C:
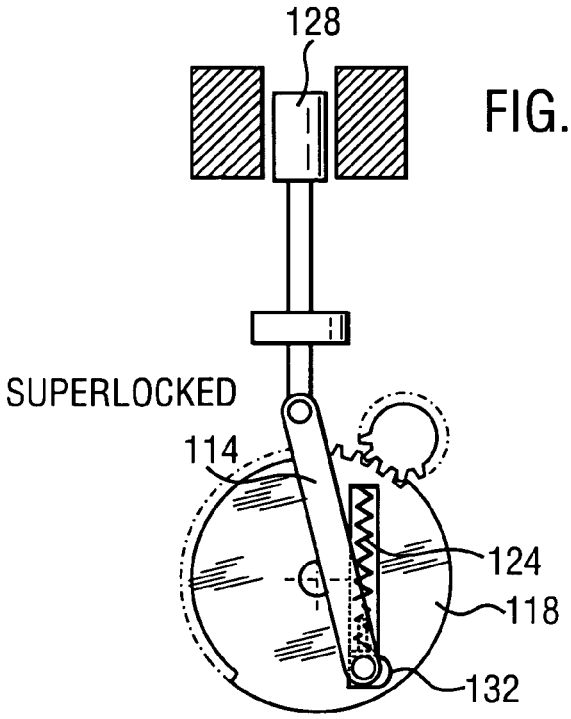

With reference now to FIGS. 2A to 2C, in which components that perform substantially the same function as those of FIGS. 1A to 1D are labeled 100 greater than those in FIGS. 1A to 1D and the general principle of operation of the lock mechanism 110 is the same, the lock mechanism 110 has a connection rod 114 defining an abutment 113 at a lower end 114B thereof, which acts in a notch 132 located at a second end 122B of a channel 122. The abutment 113 also acts under the biasing force of a spring 124. The purpose of the notch 132 is to retain the abutment 113 to achieve a direct drive link between a sill button 112 and the lock gear 118 when the lock mechanism 110 is moved between its unlocked position (FIG. 2A) and its locked position (FIG. 2B).

Furthermore, a sill button head 128 is arranged relative to a door panel 126 such that the sill button 112 is prevented from being manually displaced from the unlocked position (FIG. 2A) by a sill button stop 130. However, the sill button head 128 is able to retreat below an exterior surface of the door panel 126 so that it cannot be accessed when the lock mechanism 110 is in the locked and superlocked positions (FIGS. 2B and 2C, respectively). In the unlikely event that the sill button head 128 is manually accessed when the lock mechanism 110 is in the superlocked condition and an attempt is made to move the latch from its superlocked condition, the lock mechanism 110 will act in a similar manner to the embodiment shown in FIG. 1D. It will be clear that upon attempting to move the lock mechanism 110 manually from its superlocked position, the abutment 113 does not engage the notch 132 by virtue of the angle between the connection rod 114 and the channel 122. The activation of the sill button 112 when the lock mechanism 110 is in the superlocked position moves the abutment 113 away from the notch 132.

Figure 3:
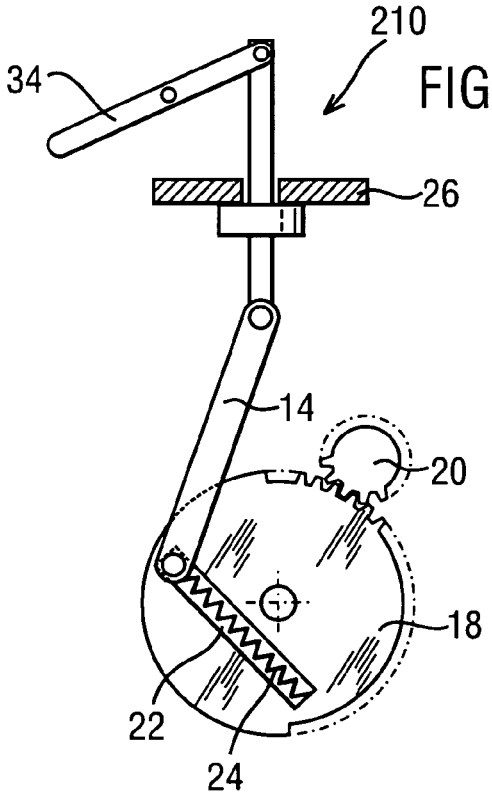
FIG. 3 is a schematic view of a third embodiment of the lock mechanism in accordance with the present invention.

FIG. 3 shows a lock mechanism 210 similar to that shown in FIGS. 1A to 1D, where the sill button is replaced with a two position toggle switch 34. The action of the lock mechanism 210 when an attempt is made to move it from the superlocked position is similar to that shown in FIG. 1D.

FIGS. 4A to 4E show a latch mechanism 40 similar to the lock mechanism 10 shown in FIGS. 1A to 1D with the additional function of an inside lock override release. The inside lock override release sequentially unlocks a locked latch and then subsequently releases the latch during a single pull of the inside lock override release.

Figure 4A:
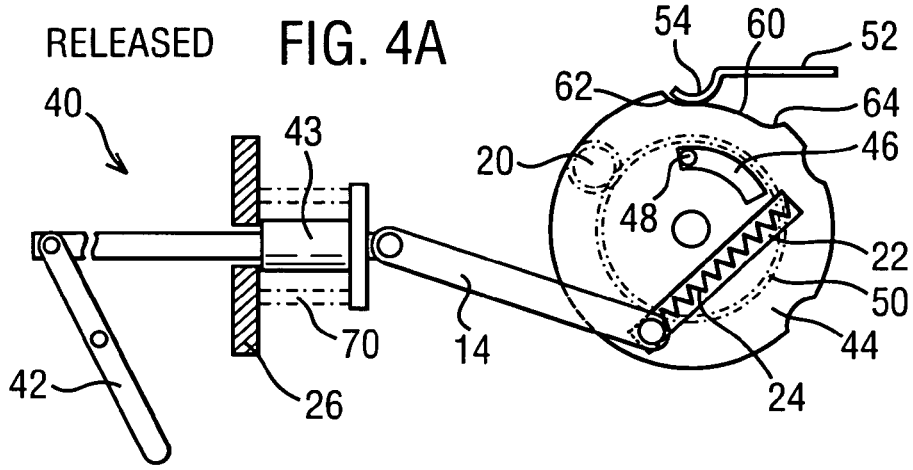
FIGS. 4A to 4E are schematic views of a first embodiment of a latch mechanism in accordance with the present invention.
Figure 4B:
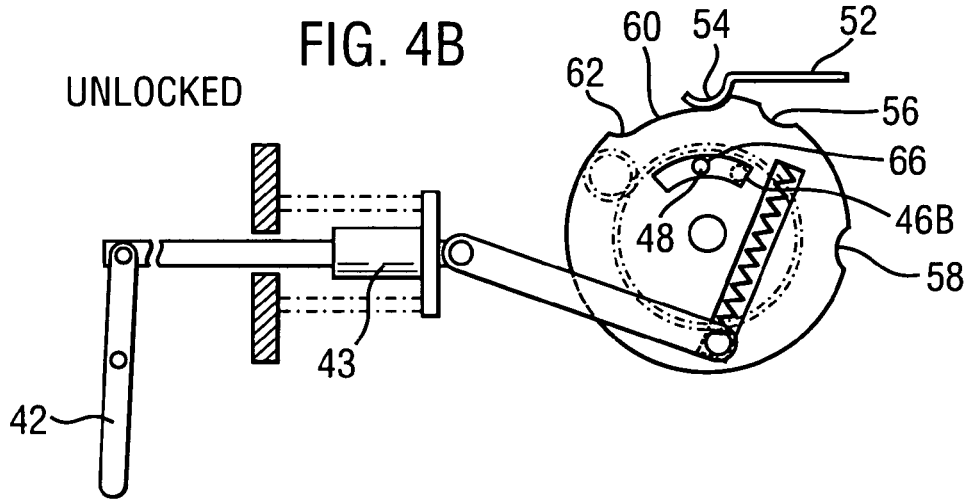
Figure 4C:
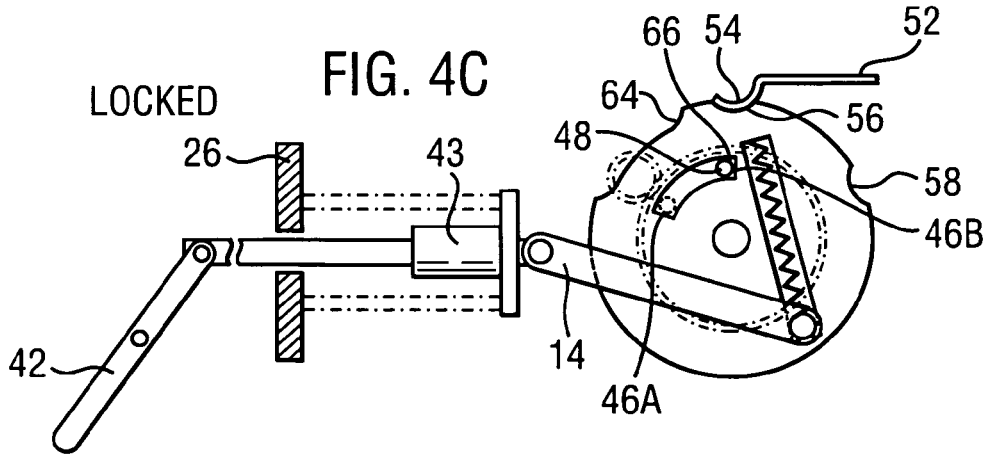

In one embodiment, the inside lock override release is in the form of an inside release lever 42 having a released position shown (FIG. 4A), an unlocked position (FIG. 4B) and a locked position (FIG. 4C). The inside release lever 42 is connected to a release lock gear 44 by the connection rod 14. The release lock gear 44 has a channel 22 that retains a spring 24 in a similar fashion as the embodiment shown in FIGS. 1A to 1D. The release lock gear 44 defines an arcuate slot 46 for receiving a lock gear pin 48. The lock gear pin 48 is mounted on a further lock gear 50. The further lock gear 50 is driven by a stepper motor (not shown for clarity) via the pinion gear 20. A leaf spring 52 contacts an outer profile of the release lock gear 44 and has a head 54 biased toward the outer profile of the release lock gear 44.

Figure 4D:
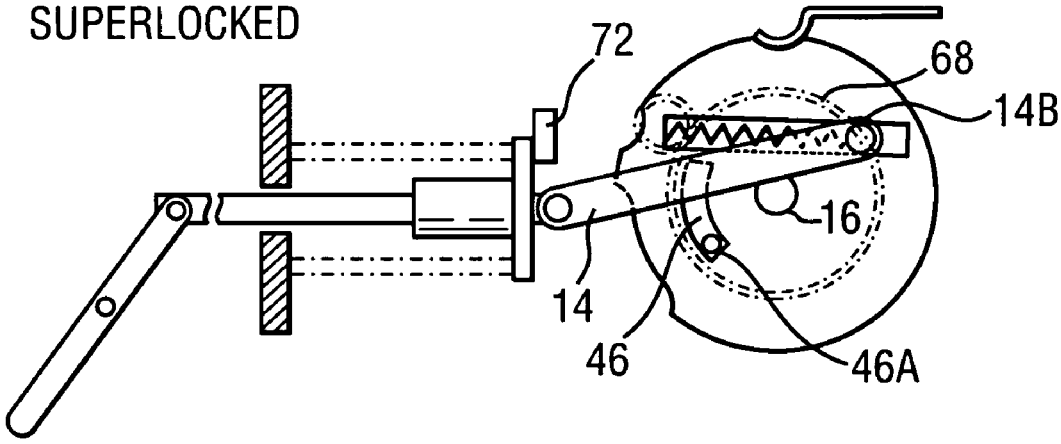
Figure 4E:
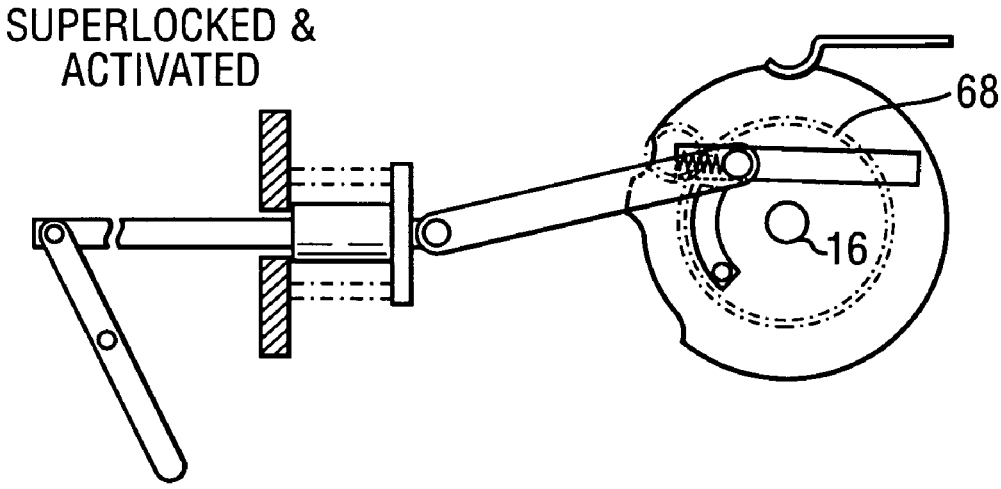
Figure 5A:
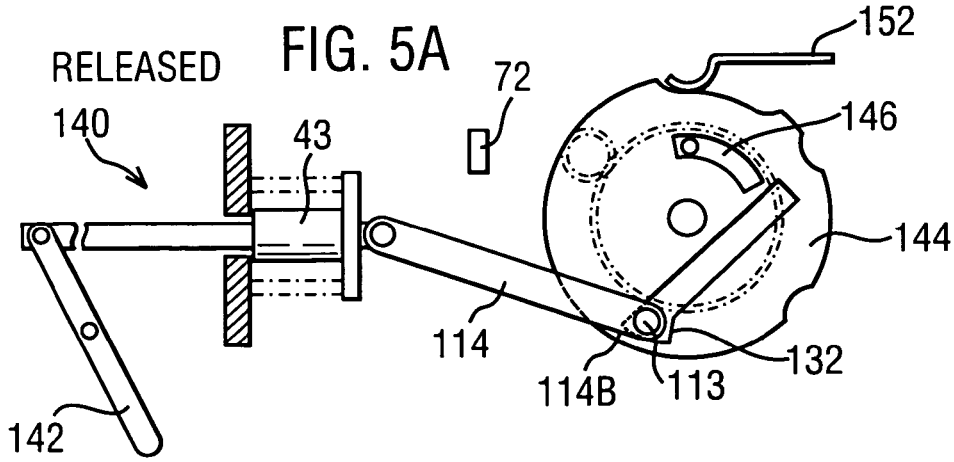
FIGS. 5A to 5E are schematic views of a second embodiment of a latch mechanism according to the present invention.
Figure 5B:
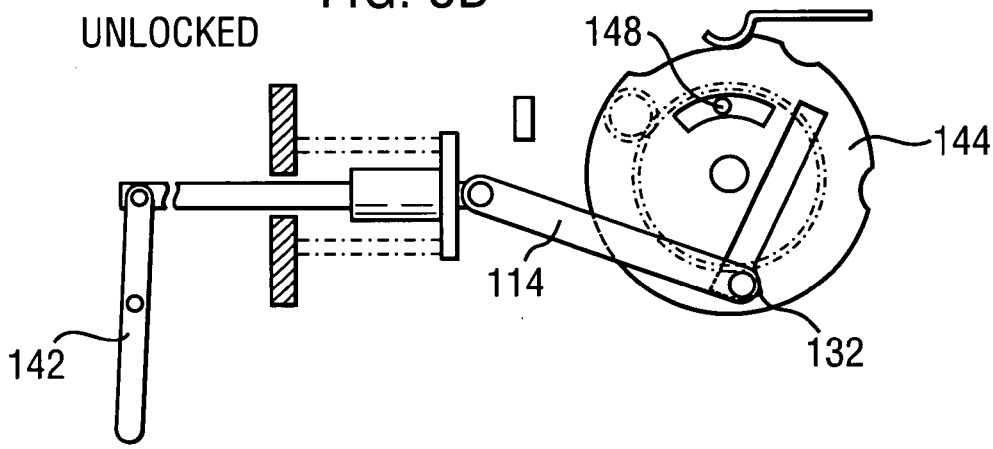
Figure 5C:
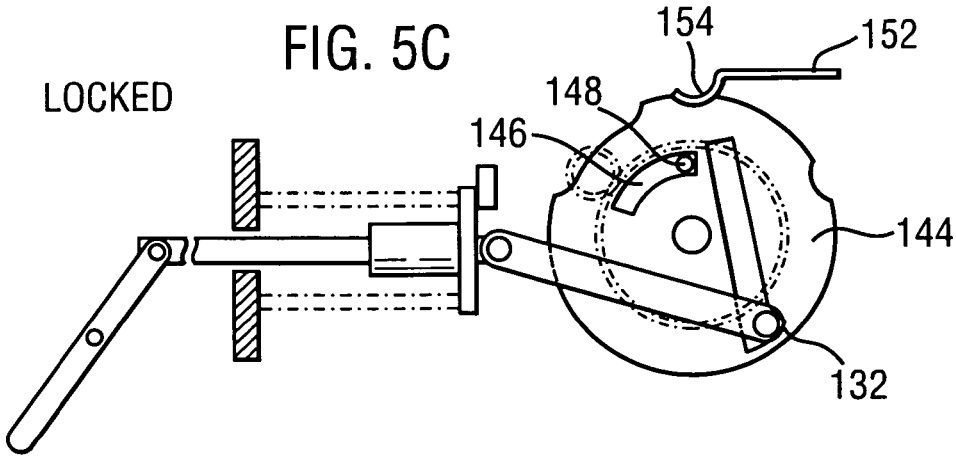
Figure 5D:
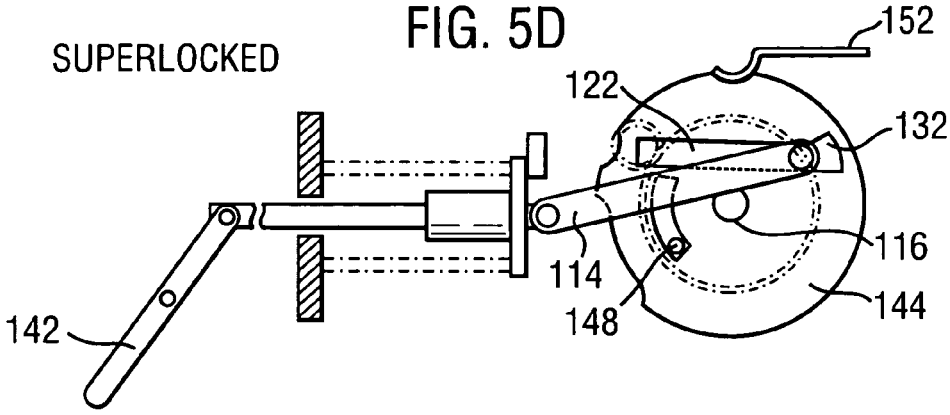
Figure 5E:
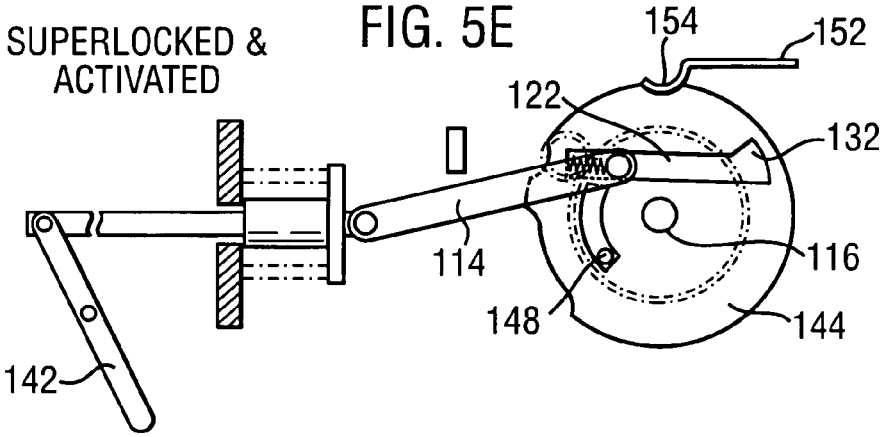

The outer profile of the release lock gear 44 defines a first detent position 56 and a second detent position 58. The outer profile further defines a flat 60 having a first abutment position 62 and a second abutment position 64. Both the first and second detent positions 56, 58 and the first and second abutment positions 62, 64 are designed to engage the head 54 of the leaf spring 52. The release lock gear 44 has a released position (FIG. 4A) corresponding to the released position of the inside release lever 42, an unlocked position (FIG. 4B) corresponding to the unlocked position of the inside release lever 42, a locked position (FIG. 4C) corresponding to the locked position of the inside release lever 42, and a superlocked position (FIG. 4D). The further lock gear 50 has a non-superlock rest position 66 (FIGS. 4B and 4C) and a superlock position 68 (FIGS. 4D and 4E). Note that the position of the lock gear pin 48 changes as the further lock gear 50 changes position.

The operation of the latch mechanism is as follows:

FIGS. 4A to 4E show the latch mechanism 40 in its released position when it has been manually activated by a vehicle occupant. An inside release lever stop 43 prevents further clockwise rotation of the release lock gear 44 by abutting against the door panel 26. The latch arrangement is provided with a door panel spring 70, which returns the inside release lever 42 from the release position shown in FIG. 4A to the unlocked position shown in FIG. 4B when the vehicle occupant lets go of the inside release lever 42. Thus, under the action of the door panel spring 70, the release lock gear 44 rotates to its unlocked position as shown in FIG. 4B, in which the leaf spring 52 is located at the second abutment position 64 of the flat 60 and thus acts as a detent. It will be noted that the lock gear pin 48 has not been caused to move.

With reference now to FIG. 4C, manual actuation of the inside release lever 42 to lock the mechanism causes rotation of the release lock gear 44 such that the head 54 of the leaf spring 52 locates at the first detent position.

It will be appreciated that it is equally possible to repeat the above steps in reverse order, moving from the locked position shown in FIG. 4C to the unlocked position shown in FIG. 4B. A continued actuation of the inside release lever 42 will release the latch mechanism 40 by moving the inside release lever 42 to the position shown in FIG. 4A.

Starting at the position shown in FIG. 4B, the latch mechanism 40 can be electrically locked by moving the lock gear pin 48 via the further lock gear 50 from its position shown in FIG. 4B to a position (shown using broken lines in FIG. 4C) where it is located at a first end 46A of the slot 46, thus driving the release lock gear 44 to the position shown in FIG. 4C. The lock gear pin 48 is then returned to the non-superlock rest position 66 shown, in FIG. 4C, thereby locking the latch mechanism 40. Starting at the position shown in FIG. 4C, the latch mechanism 40 can be electrically unlocked by moving the lock gear pin 48 from the non-superlock rest position 66 to a position (shown using broken lines in FIG. 4B) where it is arranged at a second end 46B of the slot 46, thus driving the release lock gear 44 to the position shown in FIG. 4B before returning the lock gear pin 48 to the non-superlock rest position 66.

To superlock the latch mechanism 40, the stepper motor drives the further lock gear 50 via the pinion gear 20 to move the lock gear pin 48 from its non-superlock rest position 66 to drive against a first end 46A of the slot 46. This causes the rotation of the release lock gear 44 from its position shown in FIG. 4C to its position shown in FIG. 4D in which the inside release lever stop 43 abuts a chassis stop 72 (shown only in FIG. 4D for clarity). In this position, the abutment 13 has been moved over-center of the pivot 16, and as a result the angle between the longitudinal axis of the connection rod 14 and the elongate axis of the channel 22 is small.

Like the lock mechanism 10 embodiment of FIGS. 1A to 1D, it is conceivable that the abutment 13 does not go over-center as long as angle between the connection rod 14 and the channel 22 is sufficiently acute that the spring 24 will compress upon actuation of the inside release lever 42 in an attempt to move the latch mechanism 40 from the superlocked position.

Consequently, when the inside release lever 42 is moved in an attempt to move the latch mechanism 40 from the superlocked position shown in FIG. 4D, the spring 24 is compressed as shown in FIG. 4E. As a result, there is no movement of the release lock gear 44, rendering ineffectual the movement of the inside release lever 42 when the latch mechanism 40 is in its superlocked position.

To un-superlock the latch mechanism 40, the stepper motor drives the further lock gear 50 via the pinion gear 20 to move the lock gear pin 48 from its superlocked position to drive against a second end 46B of the slot 46. This causes the rotation of the release lock gear 44 from its position shown in FIG. 4D to its position shown in FIG. 4C, thereby putting the latch mechanism 40 into a locked (but not superlocked) state.

The interaction of the abutment 13, the spring 24 and the channel 22 during the operation of the latch mechanism 40 between the released, locked and unlocked states is similar to that exhibited by the lock mechanism 10 shown in FIGS. 1A through 1D.

Of course, it is possible for the latch mechanism 40 to be electrically operated directly from the unlocked position (FIG. 4B) to the superlocked position (FIG. 4D), and likewise from the superlocked position (FIG. 4D) to the unlocked position (FIG. 4B).

In FIGS. 5A to 5E, a latch mechanism 140, similar to the latch mechanism 40 of FIGS. 4A to 4E, has a notch 132 arranged at a second end 122B (now shown) of a channel 122 and does not include a spring. The geometry of the notch 132 is such that a spring is not required to provide a biasing force against an abutment 113 to provide a constant drive connection between a connection rod 114 and a release lock gear 144 when the latch mechanism 40 is moved between the released, unlocked, and locked positions.

It will be noted that during use of the latch mechanism, the spring of each of the lock and latch mechanisms above acts only in one direction, i.e. in compression.

Figure 6:
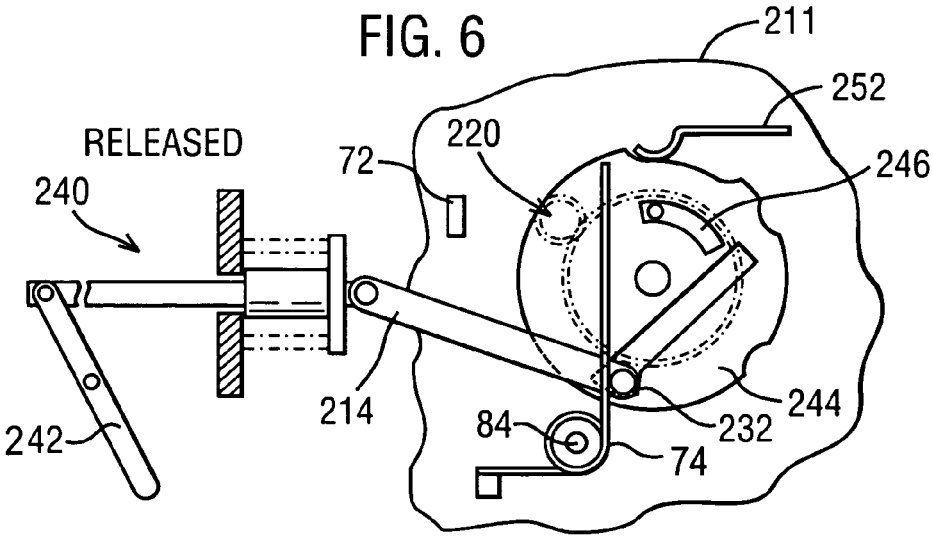
FIG. 6 is a schematic view of a third embodiment of a latch mechanism in accordance with the present invention.

FIG. 6 shows a latch mechanism 240 similar to that shown in FIGS. 5A to 5E. The latch mechanism 240 in this embodiment has a coil spring 74 mounted on a chassis 211 of the latch mechanism 240 on a coil spring pin 84, and which is reacted by a coil spring stop. The coil spring 74 acts in combination with a notch 232 similar to that illustrated in FIGS. 5A through 5E. The coil spring 74 provides resilience against movement of an inside release lever 242 when an attempt is made to move the inside release lever 242 from the superlocked position to the released position. The coil spring 74 in this embodiment performs the same function as the door panel spring 70 of the embodiment shown in FIGS. 4A to 4E. The operation of the latch mechanism 240 is otherwise similar to that shown in FIGS. 4A to 4E.

Figure 7:
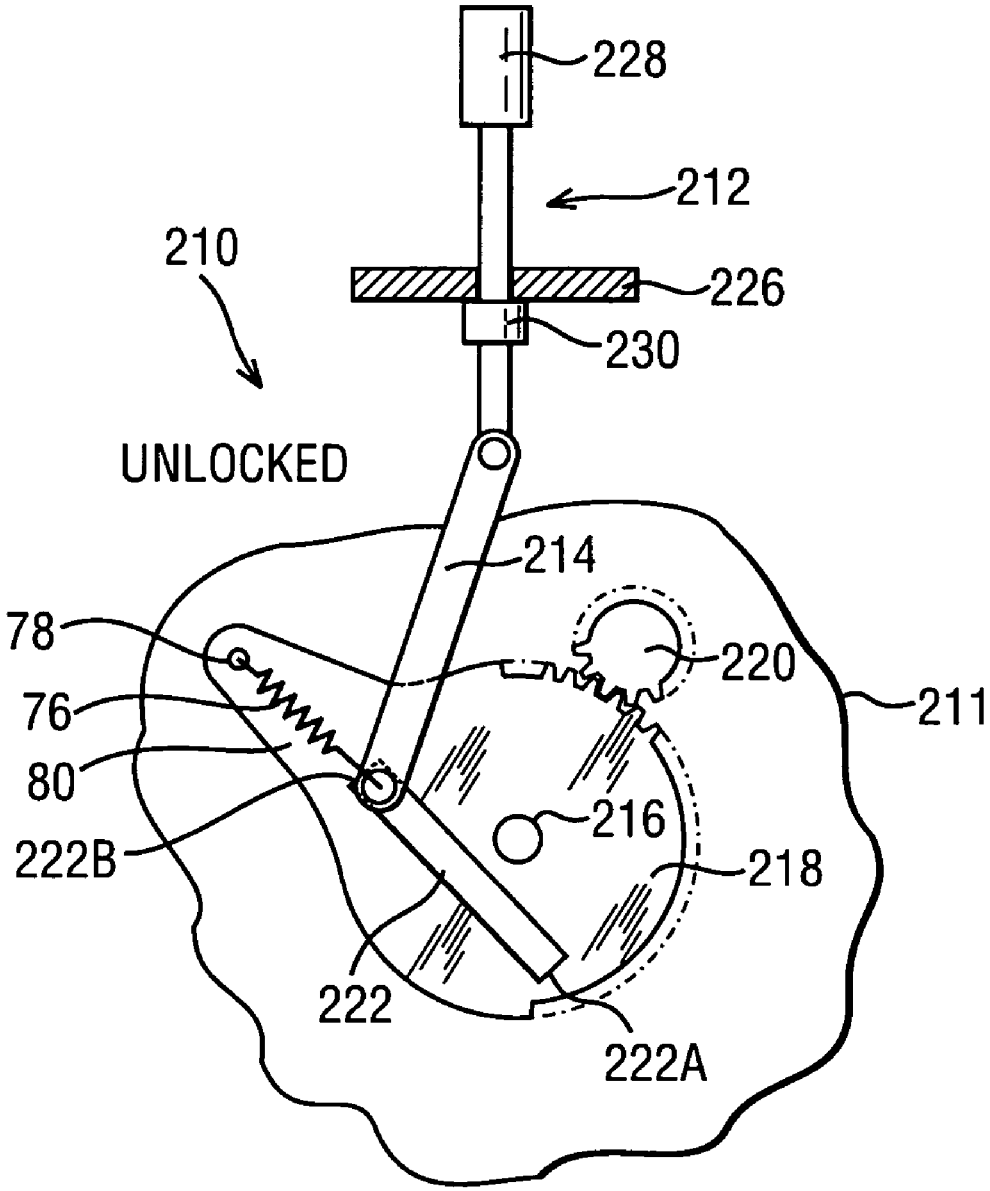
FIG. 7 is a schematic view of a fourth embodiment of a latch mechanism in accordance with the present invention.

FIG. 7 shows a lock mechanism 210 having a tension spring 76 in place of the spring 24 of the embodiment of FIGS. 1A to 1D. The tension spring 76 is mounted on a mount that is retained by a lug 80 of a lock gear 216. This embodiment operates in the same manner as the embodiment shown in FIGS. 1A to 1D. It will be appreciated that an end of the tension spring 76 could be fixed to chassis 211 instead of the lug 80 in an alternative embodiment.

It is conceivable within the scope of the invention that the notch 132, 232, the door panel spring 70, or the coil spring 74 are applicable to any of the lock mechanisms or latch mechanisms described previously.

It is also conceivable within the scope of the invention that a DC motor and solenoid arrangement of any known type be used in place of the stepper motor in any of the lock or latch arrangements described herein.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

The invention claimed is:

1. A lock mechanism for a vehicle, the lock mechanism comprising:

a manually actuable element;

a lock lever having a locked position, an unlocked position and a superlocked position relating to a locked condition, an unlocked condition and a superlocked condition of the lock mechanism, respectively, the manually actuable element being connected to the lock lever via a transmission path, wherein the lock lever is rotatable about an axis of rotation between the locked position and the unlocked position by operation of the manually actuable element;

an actuator that rotates the lock lever about the axis of rotation between the locked position, the unlocked position and the superlocked position; and a rigid link in the transmission path, wherein the rigid link is pivotable relative to the manually actuable element and has a first end in driven connection with the manually actuable element and a second end defining an abutment for selectively driving the lock lever via a drive feature, wherein the drive feature couples the abutment to the lock lever so that the abutment follows an arcuate path centered on the axis of rotation when the lock lever is rotated about the axis of rotation between the locked position and the unlocked position by operation of the manually actuable element, wherein the drive feature decouples the abutment from the lock lever when the manually actuable element is actuated in an attempt to move the lock lever from the superlocked position such that the abutment moves relative to the lock lever, and wherein the drive feature includes an elongate slot in the lock lever, the elongate slot including a slot end and a notch arranged at the slot end for engaging the abutment, and the abutment rests partly in the notch and partly in the elongate slot when the lock lever is in one of the locked position and the unlocked position.

2. The lock mechanism according to claim 1 wherein the drive feature includes a resilient member.

3. The lock mechanism according to claim 1 wherein the elongate slot includes an elongate axis that is located upon a chord of the axis of rotation.

4. The lock mechanism according to claim 3 wherein the elongate slot includes a longitudinal midpoint, and the axis of rotation is arranged between the longitudinal midpoint of the elongate slot and the first end of the rigid link.

5. The lock mechanism according to claim 1 wherein a line between the first end and the second end of the rigid link is arranged substantially to a first side of the axis of rotation when the lock mechanism is in one of the unlocked condition and the locked condition, and wherein the line is arranged substantially to a second side of the axis of rotation when the lock mechanism is in the superlocked condition such that the second end of the rigid link has moved over-center with respect to the axis of rotation.

6. The lock mechanism according to claim 1 wherein the elongate slot includes a longitudinal centerline, and the longitudinal centerline of the elongate slot and a line between the first end and the second end of the rigid link form an angle of between 0 and 20 degrees when the lock mechanism is in the superlocked position.

7. The lock mechanism according to claim 1 wherein the manually actuable element is a sill button.

8. The lock mechanism according to claim 1 wherein the manually actuable element is a two position toggle.

9. A latch mechanism for a vehicle, the latch mechanism comprising:

a lock mechanism including:

a manually actuable element;

a lock lever having a locked position, an unlocked position and a superlocked position relating to a locked condition, an unlocked condition and a superlocked condition, respectively, of the lock mechanism, the manually actuable element being connected to the lock lever via a transmission path;

an actuator that rotates the lock lever about an axis of rotation between the locked position, the unlocked position and the superlocked position; and a rigid link in the transmission path, wherein the rigid link is pivotable relative to the manually actuable element and has a first end in driven connection with the manually actuable element and a second end defining an abutment for selectively driving the lock lever via a drive feature, wherein the drive feature couples the abutment to the lock lever so that the abutment follows an arcuate path centered on the axis of rotation when the lock lever is rotated about the axis of rotation between the locked position and the unlocked position by operation of the manually actuable element, wherein the drive feature decouples the abutment from the lock lever when the manually actuable element is actuated in an attempt to move the lock lever from the superlocked position such that the abutment moves relative to the lock lever, and wherein the lock lever has a released position corresponding to a released condition of the latch mechanism, and wherein the lock lever is moveable between the released position, the locked position and the unlocked position by operation of the manually actuable element.

10. The latch mechanism according to claim 9 further including a chassis, wherein the lock lever is rotatably mounted on the chassis, wherein the drive feature includes a coil spring having a first arm and a second arm, wherein the second arm is mounted in a fixed relationship relative to the axis of rotation and the first arm communicates with the abutment such that the coil spring biases the rigid link in a direction away from the manually actuable element.

11. The latch mechanism according to claim 10 wherein one of the first arm and the second arm of the coil spring is mounted on the chassis.

12. The latch mechanism according to claim 11 wherein the manually actuable element is an inside release lever.

13. The latch mechanism according to claim 9 wherein the drive feature includes a resilient member.

14. The latch mechanism according to claim 9 wherein the drive feature includes an elongate slot in the lock lever, and the elongate slot includes a slot end and a notch arranged at the slot end for engaging the abutment.

15. The latch mechanism according to claim 14 wherein the abutment rests partly in the notch and partly in the elongate slot when the lock lever is in one of the locked position and the unlocked position.

16. A lock mechanism for a vehicle, the lock mechanism comprising:

a manually actuable element;

a lock lever having a locked position, an unlocked position and a superlocked position relating to a locked condition, an unlocked condition and a superlocked condition of the lock mechanism, the manually actuable element being connected to the lock lever via a transmission path, wherein the lock lever is rotatable about an axis of rotation between the locked position and the unlocked position by operation of the manually actuable element;

an actuator that rotates the lock lever about the axis of rotation between the locked position, the unlocked position and the superlocked position; and a rigid link in the transmission path, wherein the rigid link is pivotable relative to the manually actuable element and has a first end in driven connection with the manually actuable element and a second end defining an abutment for selectively driving the lock lever via a drive feature, wherein the drive feature includes a resilient member, wherein the drive feature couples the abutment to the lock lever so that the abutment follows an arcuate path centered on the axis of rotation when the lock lever is rotated about the axis of rotation between the locked position and the unlocked position by operation of the manually actuable element, and wherein the drive feature decouples the abutment from the lock lever when the manually actuable element is actuated in an attempt to move the lock lever from the superlocked position such that the abutment moves relative to the lock lever.

17. The lock mechanism according to claim 16 wherein the resilient member is a helical spring.

18. The lock mechanism according to claim 17 wherein the helical spring is a compression spring.

19. The lock mechanism according to claim 16 wherein the resilient member is located within an elongate slot in the lock lever.

20. The lock mechanism according to claim 19 wherein the resilient member includes a first end and a second end, and the elongate slot includes a slot end, and the first end of the resilient member abuts the abutment and the second end of the resilient member abuts the slot end of the elongate slot in the lock lever.

21. The lock mechanism according to claim 16 wherein the resilient member acts only in a single direction.

22. The lock mechanism according to claim 16 wherein the resilient member is located within an elongate slot in the lock lever, the elongate slot having a slot end and a notch arranged at the slot end for engaging the abutment.

* * * * *